US005212860A

United States Patent [19]

Lakey

[11] Patent Number: 5,212,860

[45] Date of Patent: May 25, 1993

[54] TOOL FOR ATTACHING FABRIC TOP TO BOAT COCKPIT FROM INSIDE THE BOAT

[76] Inventor: Roger C. Lakey, 576 N. Tomahawk Island Dr., Portland, Oreg. 97217

[21] Appl. No.: 893,938

[22] Filed: Jun. 5, 1992

[51] Int. Cl.[5] ..... B25B 27/00

[52] U.S. Cl. ..... 29/270

[58] Field of Search ..... 29/267, 270, 278, 229; 81/900, 3.55; 254/25, 28; 7/151, 161, 169, 170

[56] References Cited

U.S. PATENT DOCUMENTS

| | | | |
|---|---|---|---|
| 1,071,618 | 8/1913 | Hobbs | 81/177.1 |
| 1,589,683 | 6/1926 | Clinger | 29/278 |
| 1,596,678 | 8/1926 | Miller | 29/270 |
| 2,597,381 | 5/1952 | Roper | 29/229 |
| 2,759,383 | 8/1956 | Mrazik | 7/151 |
| 2,835,028 | 5/1958 | Wurzel | 29/229 |
| 3,071,849 | 1/1963 | Krohm | 29/270 |
| 3,174,216 | 3/1965 | Hamilton | 29/270 |
| 3,470,600 | 10/1969 | Hosbach | 29/229 |
| 3,713,200 | 1/1973 | Burns | 254/131 |
| 4,096,618 | 6/1978 | Perline et al. . | |
| 4,197,626 | 4/1980 | Golovich | 29/270 |
| 4,304,019 | 12/1981 | Sava | 254/131 |
| 4,694,550 | 9/1987 | Grove . | |
| 4,953,903 | 9/1990 | Warner . | |
| 5,079,791 | 1/1992 | Grech | 29/267 |

FOREIGN PATENT DOCUMENTS

| | | | |
|---|---|---|---|
| 2166681 | 5/1986 | United Kingdom | 254/18 |

*Primary Examiner*—Robert C. Watson

[57] ABSTRACT

A tool for assisting a person to attach the fabric top of a boat to the front, back, and sides of the boat cockpit while standing safely inside the boat cockpit. The tool consists of a long flat blade joined to a handle. The flat blade contains a notch that fits behind the bell-shaped fastener elements that are located on the inside of the fabric top and which secure the fabric top into place. The flat portion of the blade is long enough to reach the complementary fastener elements on the outside edges of the cockpit when pulling the fabric top tautly into place. The handle is positioned at an angle to the notched blade so a person can grasp the tool firmly by the handle and use it to pull and stretch the fabric tautly into place and to align the fastener elements without having the tool or the person's hand interfere with the positioning of the fabric top. While the notched blade is engaged behind the bell-shaped fastener element, the person then pulls the fastener element on to the complementary fastener element which is firmly mounted on the outside edge of the boat cockpit, thus securing the fastener and the fabric top into place. While remaining safely inside the cockpit, the person then proceeds to the next fastener and so on until the entire fabric top is secured.

5 Claims, 2 Drawing Sheets

TOOL FOR ATTACHING FABRIC TOP TO BOAT COCKPIT FROM INSIDE THE BOAT

BACKGROUND

Field of Invention

This invention relates to a tool to assist a person to attach the usual fabric top for a boat, such as a fishing boat, ski boat, runabout, sail boat, or cruiser, to the front, back, and sides of the boat cockpit while the person remains safely inside the cockpit.

BACKGROUND

Description of Prior Art

Many boats, such as a fishing boat, ski boat, runabout, sail boat, or cruiser, have open cockpits and are equipped with fabric tops that can be installed to form cabin-like enclosures for boat occupants. These enclosures provide weather protection, privacy, or shade. The fabric top extends from the front of the cockpit to the back and sides of the cockpit over arched frames spaced above the cockpit. The edges of the fabric top have fastener elements that are manually attachable to complementary fastener elements on the front, sides, and back of the boat cockpit. The fabric top must be pulled down taut in order to bring its fastener elements into proper alignment with the complementary fastener elements located on the outside edges of the front, sides, and back of the cockpit so that they can be attached. Since such fabric tops are designed to be pulled taut and fastened from outside the cockpit, it is extremely difficult for most persons to install such fabric tops from inside the cockpit. When a boat is afloat, and a person needs to install the fabric top, it is usually imperative that the person remain inside the cockpit for safety, because there is no safe place for the person to perform this installation from outside the cockpit, especially on smaller boats.

No solution to this basic problem has been proposed by prior art:

U.S. Pat. No. 4,694,550 to Grove (1987): Grove's tool is almost impossible for a person to use to install a fabric top on a boat from inside the boat as the tool is designed to be used on a vehicle top by applying it from outside such tops. It cannot grasp the inside of a fastener element.

U.S. Pat. No. 4,096,618 to Perline, et al (1978): Perline's tool requires that the tool be applied to a fabric top from outside a vehicle or boat, thus rendering it almost impossible for a person to use the tool to install a fabric top to a boat from inside the boat. The tool cannot grasp the inside of a fastener element.

U.S. Pat. No. 5,079,791 to Grech (1992): Grech's tool is designed to press a snap fastener closed from outside the fabric or tarpaulin that contains the snap fastener. Since the tool does not positively engage the fastener, the tool cannot be used to pull the fabric top or tarpaulin taut for fastening. The other end of the tool is designed to force two fastener elements open by use of a wedge-shaped notch. This end of the tool does not engage or grasp the bell-shaped portion of the inside of a snap fastener and therefore cannot pull taut a fabric boat top from either inside or from outside the boat. The object of Grech assumes that some other means is available for pulling taut and aligning fastener elements before the Grech tool can be applied to fasteners for closing. Grech addresses one problem only: preventing wear and tear on snap fasteners and the fabric to which they are attached while opening and closing snap fasteners. Grech does not address the problem of exposure to great danger a boat operator or other boat occupant faces when at sea or afloat in any body of water when attempting to install a fabric top to a boat cockpit when, without the tool that is the object of this invention, is not available and the operator or occupant must attempt to find secure footing outside the boat cockpit in order to pull the fabric taut and press the fasteners closed.

No tool of prior art can perform the installation of a fabric top to a boat cockpit from inside the boat, including inventions of the following additional references:

U.S. Pat. No. 4,197,626 to Golovich (1980)
U.S. Pat. No. 4,304,019 to Sava (1981)
U.S. Pat. No. 1,071,618 to Hobbs (1913)
U.S. Pat. No. 3,713,200 to Burns (1973)
U.S. Pat. No. 2,597,381 to Roper (1952)
U.S. Pat. No. 2,759,383 to Mrazik (1956)
U.S. Pat. No. 2,835,028 to Wurzel (1958)
U.S. Pat. No. 1,589,683 to Clinger (1926)
U.S. Pat. No. 3,470,600 to Hosback (1969)
U.S. Pat. No. 1,596,678 to Miller (1926)
U.S. Pat. No. 3,174,216 to Hamilton (1965)
U.S. Pat. No. 3,071,849 to Krohm (1963)
U.K. patent 2,166,681 to Cooling (1986)

Because none of the above listed references, nor any that the applicant can find, address the problem that is the object of the present invention, the present invention must therefore be unobvious. Another factor in support of unobviousness is the complete lack of any tool or device on the market today that solves the problem that is the object of the present invention. This statement is based on the applicant's 45 years of boating experience.

The present invention is directed to a novel tool to make it easier and safer for a boat occupant or operator to install a fabric top from inside the boat cockpit.

In accordance with this invention there is provided a tool having a long, flat blade angularly attached to a handle. The flat blade has a notch at one end designed to slide behind and grasp the bell-shaped fastener element located inside the edge of a fabric top for a boat. The length of the blade is slightly greater than the distance from the top edge of the boat cockpit to the complementary fastener elements permanently attached to the outside edges of the front, sides, and back of the cockpit. The handle is of a size and shape to afford a comfortable and firm grip for a person's hand. The angle between the handle and the blade is such that a person's hand will not interfere while pulling the fabric top taut and aligning the fastener elements with their complementary fastener elements on the outside of the cockpit edges. This angle also enables a person to exert great force on the fastener element and hence to the fabric top when needed for pulling the top taut. The person using this tool, when a fastener element is properly aligned with its complementary fastener element, then pulls the two elements closed, thus securing the fabric top tautly into place. The person then proceeds from fastener to fastener, closing each to complete the installation from the safety of the inside of the boat cockpit.

Objects and Advantages

A principal object of this invention is to provide a novel tool to facilitate the installing, pulling taut and attaching a fabric top for a boat to the front, back, and sides of a boat cockpit while the boat operator or other boat occupant performing the installation is safely located inside the boat cockpit.

Further objects and advantages of this invention will be apparent from the following detailed description of a presently preferred embodiment which is illustrated schematically in the accompanying drawings.

DRAWING FIGURES

In the drawings, closely related figures have the same numbers but different alphabetic suffixes.

REFERENCE NUMERALS IN DRAWINGS

Figure 2:
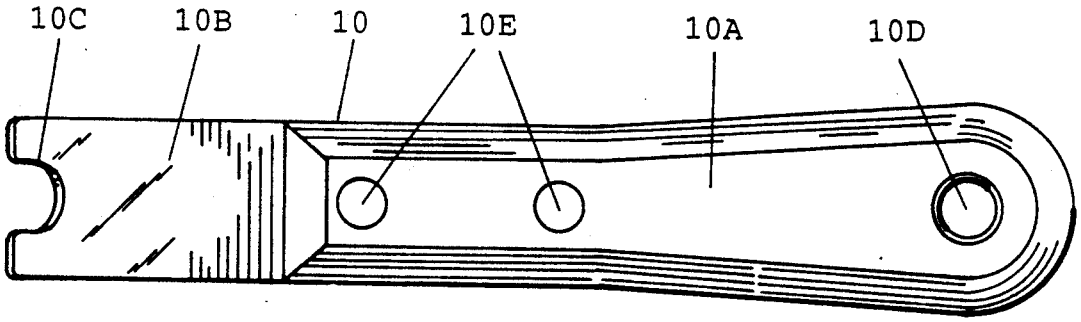
FIG. 2 is a bottom view of the tool of FIG. 1.

| Reference Numerals in Drawings | | | |
|---|---|---|---|
| 10 | tool | 14 | encapsulated spring |
| 10A | tool handle | 16 | fastener element |
| 10B | tool blade | 18 | complementary fastener element |
| 10C | notch | | |
| 10D | hole for lanyard | 20 | fabric top |
| 10E | rivets | 22 | boat cockpit edge |
| 12 | bell-shaped portion of fastener element | | |

DESCRIPTION OF A PREFERRED EMBODIMENT

FIGS. 1 to 4

Figure 1:
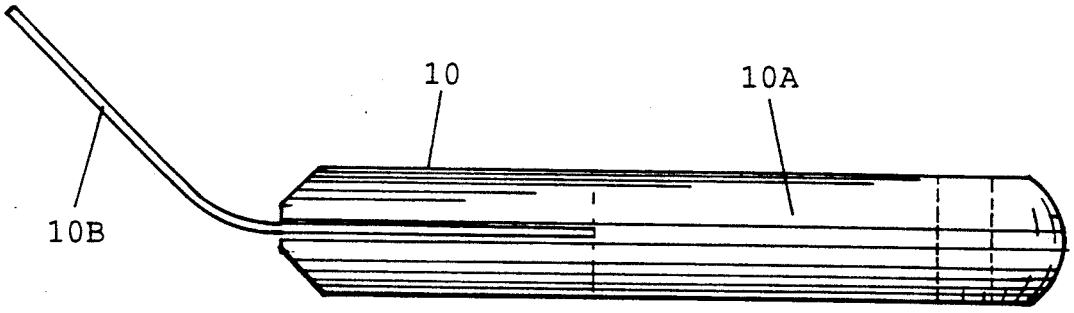
FIG. 1 is a side view of a tool for attaching a fabric top to a boat, embodying the present invention.

Referring now to the drawings, and more particularly to FIGS. 1 and 2, a preferred embodiment of the tool of the present invention is indicated by the reference character 10 and is seen to comprise an elongated handle 10A and a flat blade 10B. Handle 10A has flat parallel sides and rounded edges to facilitate gripping by hand. The edges of handle 10A are substantially parallel from the blade end of handle 10A the same distance along handle 10A as is occupied by the embedded portion of blade 10B. The edges of handle 10A then diverge from parallel and then taper to merge tangentially with the rounded outer end of handle 10A. This shape of handle 10A facilitates gripping with the fingers encircling the parallel and tapered portions of handle 10A and the thumb juxtaposed over the top end of handle 10A so that maximum force can be applied in any required direction without slipping of the grip.

Hole 10D allows attachment of a lanyard, a heavy cord that the user may install to help keep from dropping the tool overboard, achieved by threading the lanyard through hole 10D, then securing the free portion over the user's wrist.

Tool blade 10B is formed from flat stock with parallel sides, then formed into a curve between the flat portion embedded in handle 10A and the flat working portion containing notch 10C. The thickness of the working portion of blade 10B is equal to the space available in the narrow neck of the bell-shaped portion 12 of fastener element 16. The sides of notch 10C diverge slightly toward the notch opening to facilitate engaging and grasping bell-shaped portion 12 of fastener element 16. The corners and edges of notch 10C and blade 10B are rounded and smoothed so as to avoid damaging the fabric top 20 to which fastener element 16 is attached. The inner shape of notch 10C is substantially complementary to the shape of bell-shaped portion 12 of fastener element 16. Blade is stainless steel to repel rust and to resist bending.

The length of the flat working portion of blade 10B is such that notch 10C will extend over the side or edge of a boat cockpit far enough to reach complementary fastener element 18 and to close the respective fastener elements.

OPERATION

Figure 4:
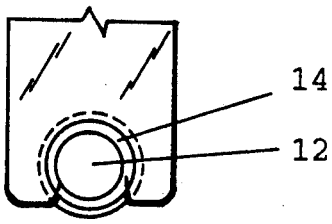
FIG. 4 is a bottom view of the blade of the tool of FIG. 1 engaged with the bell-shaped portion of the fastener element of FIG. 3.
Figure 3:
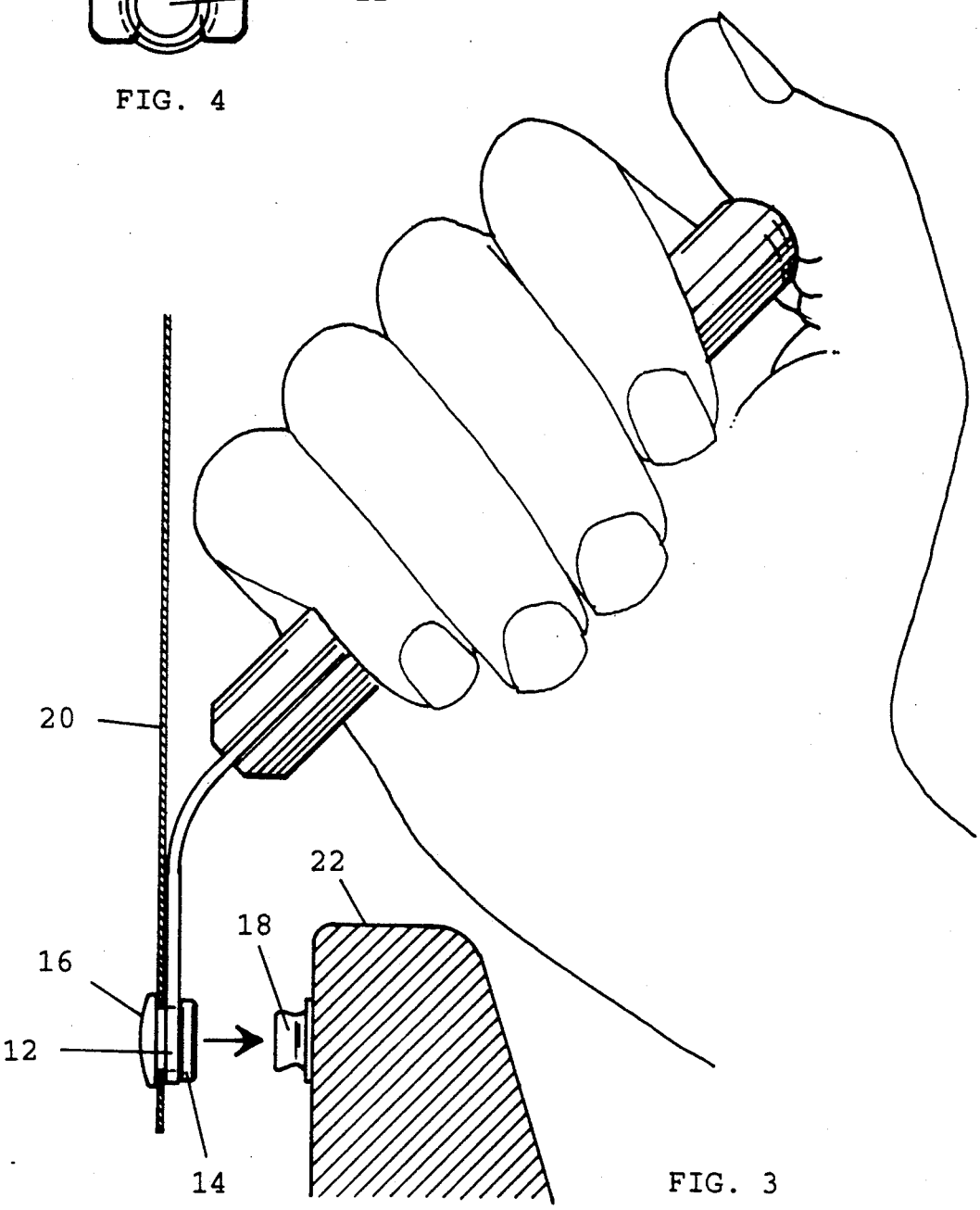
FIG. 3 is a side view of the tool of FIG. 1 at its main stage of operation while grasping the bell-shaped portion of a fabric top fastener element.

FIGS. 3 and 4

The angle and length of the flat working portion of blade 10B are such as to permit the user to grip the handle firmly and to apply force to the fabric top in any required direction without having the user's hand or handle 10A interfere with pulling the flexible fabric top 20 down to the boat cockpit edge 22.

To use the tool of this invention, the user grasps the fabric top edge 20 with a free hand, then uses the other hand to engage and grasp the bell-shaped portion 12 of fastener element 16 with blade notch 10C. User then releases his free hand from the fabric top, as the tool 10 is now controlling the placement of fabric top 20. User's free hand may now be used to stabilize user's body and stance in preparation for applying force to fabric top 20. User than pulls fastener element 16 into position over complementary fastener element 18, then further pulls fastener element 16 onto complementary fastener element 18 until encapsulated spring 14 compresses into narrow neck of fastener element 18. The user may now remove the tool from fastener element 16 by lifting the tool in a direction parallel to the plane of the base of complementary fastener element 18.

Fastener elements are usually spaced uniformly a few inches apart along the edge of the fabric top 20 that comprises a cover for a boat. The user then proceeds from one fastener element to the next until all are secured. The entire operation is accomplished from inside the boat cockpit where the user is sheltered from the weather and from hazardous conditions, such functions not being safely and conveniently accomplished if the tool of this invention were not available.

From the foregoing it will be evident that the present tool is simple and easy to use, yet highly effective in assisting a person to install and attach a fabric top to a boat cockpit from inside the boat cockpit. This eliminates the hazard of having to go outside the cockpit where there either is no place to stand safely when the boat is afloat or no place at all to stand to pull the fabric top taut and to press the fastener elements closed from outside the boat.

SUMMARY, RAMIFICATIONS, AND SCOPE

Accordingly, the reader will see that the tool of this invention can be used to secure fabric boat tops from the safety of the inside of the cockpits of boats, heretofore impossible with tools from prior art. Furthermore, the tool of this invention has additional advantages in that it extends the life of the fabric top by eliminating the need to grasp and pull by hand or by use of inappropriate tools or devices which could damage the fabric top material and its fastener elements;

it helps prevent the tearing out of a fastener element because it grips the fastener element snugly and allows the application of sufficient hand force to pull the fabric top taut, then to align and close the fastener elements;

It extends the life of fastener elements by permitting them to be aligned accurately before closing force is applied;

it facilitates the operation of damaged, pitted, or corroded fastener elements;

it facilitates safety because the size and shape of the handle enables the user to have positive control of the fabric top and its fastener elements in wet or dry, cold or warm, or inclement conditions;

it helps overcome shrinkage and stiffness in boat fabric top systems due to age or cold temperatures, factors which prevent the easy alignment of fastener elements for closure by making it possible to apply the proper force to pull the fabric top taut;

it can be used just as easily to pry fastener elements open, essential when such fasteners bind or are difficult to open by hand.

Although the description above contains many specificities, these should not be construed as limiting the scope of the invention but as merely providing illustrations of the presently preferred embodiment of this invention.

Thus the scope of the invention should be determined by the appended claims and their legal equivalents, rather than by the examples given.

I claim:

1. For use with a boat having:

a cockpit with complementary fastener elements thereon;

arched frames spaced above said cockpit;

and a flexible fabric top designed to be installed by extending said top from front to back and side to side over said frames and said cockpit, said top having fastener elements at said top's edges for attachment to said complementary fastener elements on the outside of said edges of the front, sides, and back of said cockpit;

a tool with means for pulling said fabric top into proper position for attachment from inside said boat cockpit, said attachment being accomplished by said tool engaging and grasping a bell-shaped portion of said fastener element located on the inside of said fabric top at said top's said edges, positioning said bell-shaped portion over said complementary fastener element and closing said fastener elements comprising:

an elongated flat rigid blade;

a notch in one end of said blade, said notch being shaped in a manner to provide means for said tool to engage and grasp said bell-shaped portion of said fastener element by sliding said notch and said blade behind said bell-shaped portion;

a handle on the other end of said blade;

means to angularly attach said blade to said handle to provide a firm and comfortable grip for a person's hand to pull on said fabric top;

said blade having an unobstructed flat length slightly more than the distance from said top edge of said cockpit to said complementary fastener element located outside said cockpit edge so that when a person pulls down on said tool, said blade pulls said fabric top in such a direction as to align said fastener element with said complementary fastener element so that said fastener elements can be closed;

said blade having sufficient stiffness to resist a bending moment while closing said fastener elements.

2. The tool according to claim 1 wherein said notch presented by said blade is shaped substantially complementary to said bell-shaped portion of said fastener element thereon over a substantial part of the circumference of said bell-shaped portion thereof.

3. The tool according to claim 1 wherein said notch has slightly divergent lead-in sides with an inner spacing substantially equal to the diameter of said bell-shaped portion of said fastener element.

4. The tool according to claim 1 wherein said lead-in sides of said notch present rounded corners at the open end of said notch to facilitate engaging said bell-shaped portion.

5. The tool according to claim 1 wherein said blade is composed of a rust-resistant material such as stainless steel.

* * * * *